US005329910A

United States Patent [19]

Tanaka

[11] Patent Number: 5,329,910

[45] Date of Patent: Jul. 19, 1994

[54] EFFICIENT AUXILIARY ENGINE COMBUSTION SYSTEM

[75] Inventor: Kazuo Tanaka, Kamagaya, Japan

[73] Assignee: Yugen Gaisha Shunwa Denshi Kikaku, Kamagaya, Japan

[21] Appl. No.: 159,276

[22] Filed: Nov. 30, 1993

[30] Foreign Application Priority Data

Dec. 28, 1992 [JP] Japan ..... 4-093386[U]

[51] Int. Cl.[5] ..... F02M 27/04

[52] U.S. Cl. ..... 123/536; 123/538; 123/539

[58] Field of Search ..... 123/536, 537, 538, 539; 60/39.02; 96/17; 210/243

[56] References Cited

U.S. PATENT DOCUMENTS

| | | | |
|---|---|---|---|
| 4,605,523 | 8/1986 | Smillie | 123/538 |
| 4,966,121 | 10/1990 | Koga | 123/536 |
| 5,085,773 | 2/1992 | Danowski | 210/243 |
| 5,134,985 | 8/1992 | Rao | 123/538 |

FOREIGN PATENT DOCUMENTS

| | | | |
|---|---|---|---|
| 0198366 | 10/1985 | Japan | 123/536 |
| 1402697 | 6/1988 | U.S.S.R. | 123/538 |

*Primary Examiner*—Tony M. Argenbright
*Assistant Examiner*—M. Macy
*Attorney, Agent, or Firm*—Juettner Pyle Lloyd & Piontek

[57] ABSTRACT

An efficient auxiliary engine combustion system is capable of controlling the emission of exhausted carbon and other exhaust matter by improving the combustion efficiency of engines by installing the system to the air intake pipe or fuel feeding pipe or both. The auxiliary engine combustion system has a belt shaped cover in which a first metal plate, rubber plate, second metal plate, capacitor and third copper plate are therein aligned and contained. Between the first metal copper plate and second metal plate lies a capacitor. A first terminal of the capacitor is affixed to the first metal plate. A second terminal is affixed to second metal plate. Static electricity charges the capacitor to provide a positive charge to neutralize and decompose concentrations of negative ions entrained in the incoming air or fuel flow.

16 Claims, 5 Drawing Sheets

EFFICIENT AUXILIARY ENGINE COMBUSTION SYSTEM

FIELD OF THE INVENTION

The present invention relates to an efficient auxiliary engine combustion system capable of controlling carbon monoxide, hydrocarbons, black smoke, and other undesirable exhaust constituents by improving the combustion efficiency by control of negative ion concentrations in air intake or fuel delivery lines or both of various types of engines such as diesel, gasoline and other engines installed on vehicles, aircraft, vessels, and the like.

BACKGROUND OF THE INVENTION

Carbon monoxide, hydrocarbons, black smoke, and other undesirable materials are exhausted from various types of conventional internal combustion engines such as diesel, gasoline and other fueled engines installed on vehicles, aircraft, vessels and the like. Such exhausted gases and particulates are one of the causes of air pollution, and the control of these emissions poses a considerable problem.

Various negative ions exist in an electrically cohesive condition within the air inducted by the air intake lines and manifolds and within the fuel provided by fuel delivery lines. The negative ions in the air/fuel mixture are usually grouped together to form a relatively large structure. For example, $O_2$ molecules in the intake air are often grouped in $O_{12}$ molecular structures. Further, $H_2O$ molecules often form $H_{24}O_{12}$ structures. Moreover, hydrocarbons are well known to be collective and form large structures. As these negative ions flow into the combustion chamber in these large, collective structures, it is believed and understood that these electrically cohesive negative ions result in the incomplete combustion of the fuel and air mixture within the combustion chamber, as well as decreasing combustion efficiency, and thereby encourage the emission of carbon monoxide, hydrocarbons, black smoke and other exhaust constituents sought to be controlled.

SUMMARY OF THE INVENTION

Therefore, in accordance with the present invention, it was contemplated that if the negative ions could be broken up or neutralized by a positive charge, efficiency and power output could be increased and undesirable emissions could be decreased. The object of the present invention is to therefore provide an efficient auxiliary engine combustion system capable of controlling the concentration of negative ions and thereby control the emission of undesirable gases and particulates by neutralizing the large collective structures of such negative ions during the air intake or fuel delivery process.

The device of the present invention is thus designed to be installed on the air intake or fuel delivery lines of an internal combustion engine in order to improve efficiency and to reduce harmful exhaust gases, particulates and other undesirable emissions. The device is designed to impart a positively charged surface or zone over which air or fuel flows when the engine is running to neutralize the negative ions in the air or fuel. As the negative and positive ions mix, the negative ions are broken into smaller molecular blocks and thus dispersed.

A device in accordance with the present invention provides an efficient auxiliary engine combustion system installed at the engine air intake or fuel delivery lines, or both, and includes a first metal plate, a dielectric insulator located on one surface of the first metal plate, a second metal plate located on one surface of the dielectric insulator, a capacitor installed at the second metal plate, and a third metal plate located on one surface of the second metal plate. Alternatively, the device of the present invention includes a first metal plate, a dielectric insulator located on the first metal plate, a second metal plate located at one surface of the dielectric insulator and a capacitor installed on the second metal plate.

The efficient auxiliary engine combustion system according to the first embodiment of the present invention is installed at the engine air intake line or manifold or fuel delivery line. As air flows into the air intake lines or manifolds or fuel flows into the fuel delivery line when the engine starts running, static electricity is charged on the air intake or fuel delivery line by the flow or air or fuel, and thereby the capacitor is charged. The static electrical charge on the air intake or fuel delivery line by the flow of air or fuel, and a resulting capacitance is likewise produced between the above mentioned first, second and third metal plates, and positive ions are generated on the surfaces of the first, second and third metal plates by electrostatic induction action.

The negative ions in electrically cohesive condition in the air or fuel are neutralized and decomposed by the positive ions generated on the surfaces of the above mentioned first, second and third metal plates, and the air or fuel in this condition is fed into the combustion chamber of the engine, resulting in a reduction in incomplete combustion, as well as an increase in combustion efficiency and power output, and thereby reduces the emission of undesirable exhaust gases and particulates. Thus, applying a positive force to the collective bodies of negatively charged molecules thus causes the collective structure of these collective molecules to break up and disperse (i.e., the $O_{12}$ molecules breaking up and dispersing as $O_2$ molecules and the $H_{24}O_{12}$ structures breaking up and dispersing as $H_2O$ molecules).

According to the second embodiment of the present invention, the system is likewise installed at the air intake or fuel delivery lines of the engine. Flow likewise creates a capacitance between the first and second metal plates, and positive ions are generated on the surfaces of the first and second metal plates by electrostatic induction action.

The negative ions existing in electrically cohesive condition in the air or fuel are neutralized and decomposed by the positive ions generated on the surfaces of the first and second metal plates. The air or fuel in this condition is fed into the combustion chamber of the engine to likewise reduce incomplete combustion in the combustion chamber, as well as increases combustion efficiency, and thereby the emission of undesirable gases and particulates is reduced.

Accordingly, the present invention provides an efficient auxiliary engine combustion system capable of controlling the emission of exhausted carbon, carbon monoxide, hydrocarbons, black smoke and other exhaust constituents. By neutralizing large concentrations of negative ions, the efficiency, power output, and reduced emissions of internal combustion engines can be realized. The invention thus provides significant advantages over the prior art. Advantages and achievements in addition to those described will become apparent from the following detailed description, as considered in conjunction with the accompanying drawings.

DETAILED DESCRIPTION OF THE PREFERRED EMBODIMENT

The following is a description of the best mode presently contemplated by the inventor for carrying out his invention. Other modes of carrying out the invention, without departing from the scope of the invention, will become apparent to those skilled in the art as the description proceeds.

Figure 1:
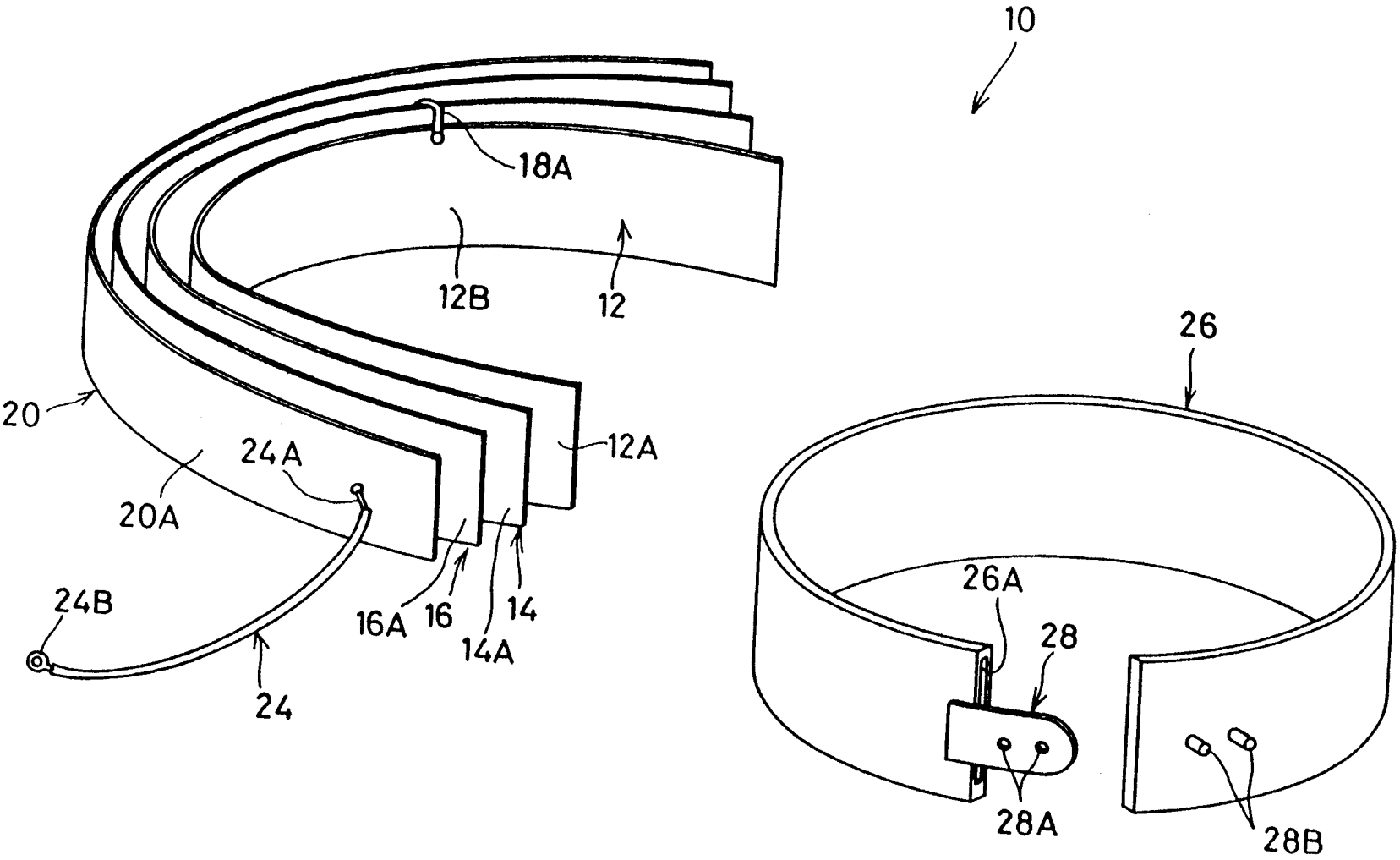
FIG. 1 is an exploded perspective view of the efficient auxiliary combustion system of the first preferred embodiment.
Figure 4:
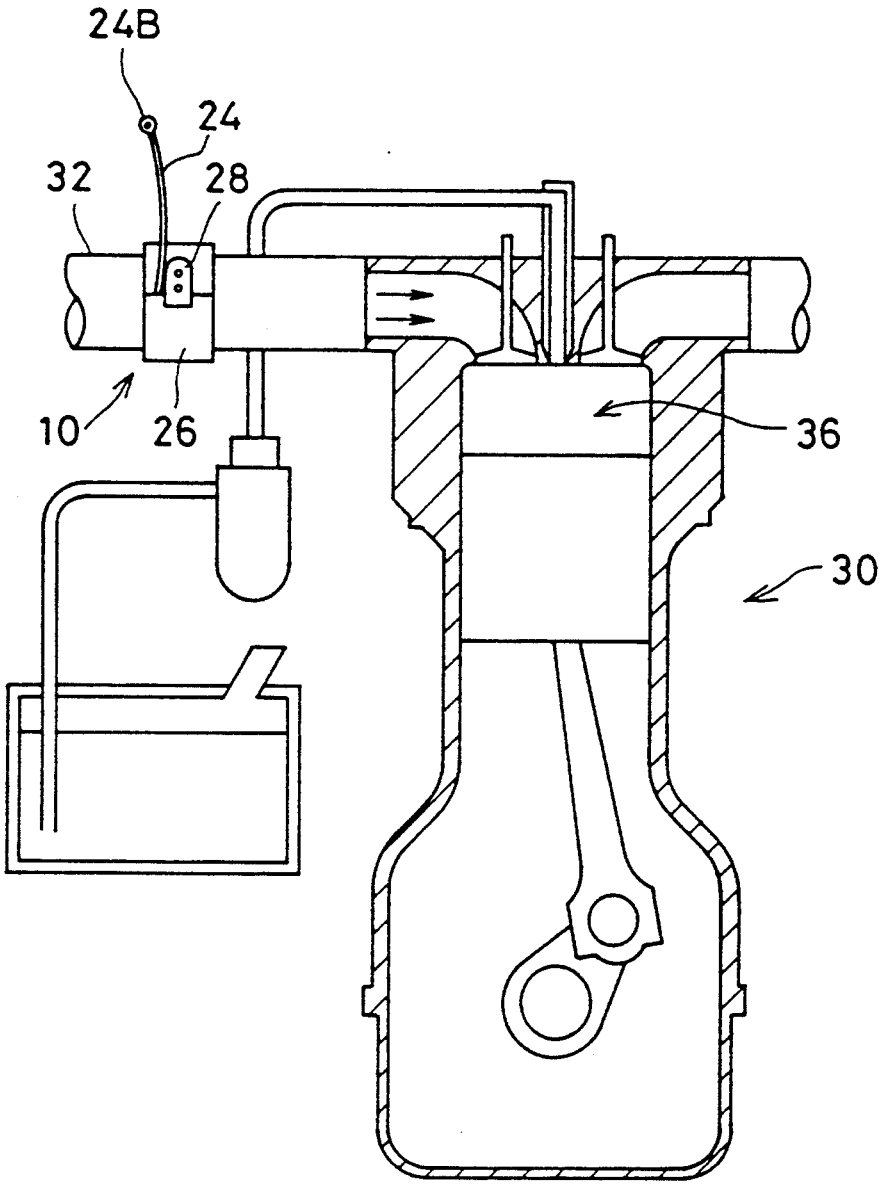
FIG. 4 is a constitutional diagram showing the installation of the efficient auxiliary engine combustion system of the first preferred embodiment.

FIGS. 1 and 4 show a first preferred embodiment of the efficient auxiliary engine combustion system 10 of the present invention. As shown therein, a rubber plate 14 acting as an insulator in belt form is located on an outer surface 12*a* of a first copper plate 12. The first copper plate 12 serves as the first metal plate, in belt form, of the efficient auxiliary engine combustion system 10. A second copper plate 16 as the second metal plate in a belt form is located on the outer surface 14*a* of the rubber plate 14. Thus, the first copper plate 12 is insulated from the second copper plate 16 by the rubber plate 14.

Figure 2:
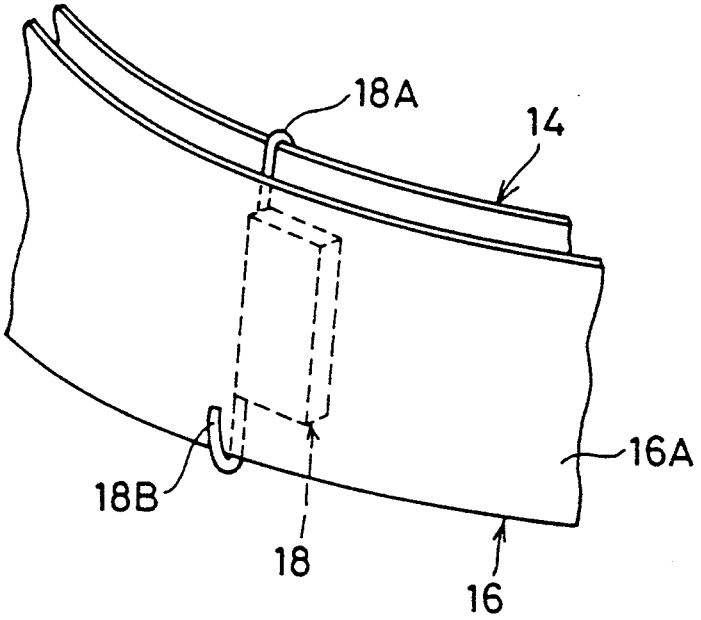
FIG. 2 is a partially enlarged perspective view of the rubber plate and the second copper plate of the efficient auxiliary engine combustion system of the first preferred embodiment.
Figure 3:
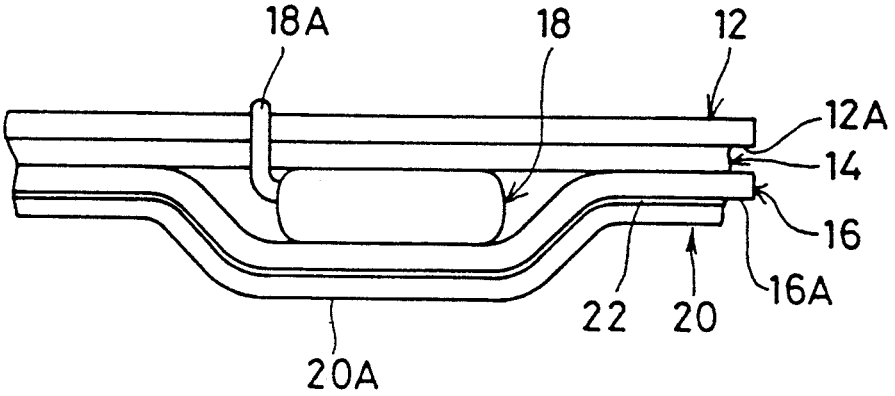
FIG. 3 is an enlarged top view of the efficient auxiliary engine combustion system of the first preferred embodiment.

As shown in FIGS. 2 and 3, a capacitor 18 is located between the rubber plate 14 and the second copper plate 16. Accordingly, the rubber plate 14 and capacitor 18 are installed between the first copper plate 12 and second copper plate 16. Since the rubber plate 14 directly contacts one surface of the capacitor 18, the rubber plate 14 also functions as a cushion and prevents the capacitor 18 from being deformed by pressure. The first terminal 18*a* protruding from one end of the capacitor 18 is fastened to the inner surface 12*b* of the first copper plate 12 with solder. Also, the second terminal 18*b* protruding from the other end of the capacitor 18 is fastened to the outer surface 16*a* of the second copper 16 plate by solder, as shown in FIG. 2.

Shown in FIG. 1, a third copper plate 20 as the third metal plate, also in belt form, is located on the outer surface 16*a* of the second copper plate 16. As best shown in FIG. 3, a plastic tape 22 is glued on the inner surface of the third copper plate 20 to prevent the electrode from shorting out. Accordingly, the second copper plate 16 is insulated from the third copper plate 20. A paper tape, rubber tape or other type of insulator may be used in place of the plastic tape 22.

As shown in FIG. 1, one end 24*a* of a grounding wire 24 is fastened to the outer surface 20*a* of the third copper plate 20 with solder. The other end 24*b* of the grounding wire 24 is fastened to a portion of the vehicle body (not shown).

The first copper plate 12, rubber plate 14, second copper plate 16, capacitor 18, and third copper plate 20 are designed to be encased in a belt shaped cover 26 which serves as a sheathing material. An insertion slit 26*a* is provided in this cover 26 so that the first copper plate 12, rubber plate 14, second copper plate 16, capacitor 18, and third copper plate 20 can be therein encased. A tongue 28 protrudes from one end of the cover 26, and holes 28*a* are provided in this tongue 28. At the same time, protrusions 28*b* are provided on the other end of the cover 26 so that the protrusions can be inserted in the holes 28*a*.

When the efficient auxiliary engine combustion system 10 is installed at the air intake line or manifold 32 of a diesel engine 30 mounted in an automobile, as shown in FIG. 4, the efficient auxiliary engine combustion system 10 is firstly wound around the air intake line 32 in such a way that the first copper plate 12 faces the surface of the air intake line 32. The efficient auxiliary engine combustion system 10 is installed at the air intake line 32 by fitting the protrusions 28*b* into the holes 28*a* of the tongue 28 of the cover 26. The other end 24*b* of the grounding wire 24 is fixed to the vehicle body (not shown). Thus, when the engine 30 begins running, air flows into the air intake line 32 as indicated by the arrows in FIG. 4. Static electricity is charged on the air intake line 32 by the air flow and this electricity charges the capacitor 18.

As capacitance is produced between the first copper plate 12, second copper plate 16 and third copper plate 20, positive ions are generated on the surfaces of the first copper plate 12, second copper plate 16 and third copper plate 20 by electrostatic induction action. Furthermore, because one end 24*a* of the grounding wire 24 is soldered to the above mentioned third copper plate 20 and the outer end 24*b* is fixed to the vehicle body (not shown), the positive ions generated on the surfaces of the first copper plate 12, second copper plate 16 and third copper plate 20 are prevented from being released.

As the negative ions in electrically cohesive condition flow into the air intake line 32, the negative ions are neutralized and decomposed by the positive ions generated on the surfaces of the above mentioned first copper plate 12, second copper plate 16 and third copper plate 20. The air in this condition is fed to the combustion chamber 36 of the engine 30, resulting in more complete combustion, as well as an improvement in combustion efficiency in the combustion chamber 36. The improvement in combustion efficiency controls the emission of carbon, carbon monoxide, hydrocarbons and other undesirable emissions. Moreover, as combustion becomes more complete, the inside of the combustion chamber 36 is deposited with less carbon. It has been found that fuel consumption can be reduced by more than 10% according to the present invention.

The advantage of the present invention is that the development of black smoke in particular can be controlled and, at the same time, the operation of the engine 30 can be made smoother by installing the efficient auxiliary engine combustion system 10 of the present invention at the air intake line 32 or at the fuel delivery line of the engine 30.

Figure 5:
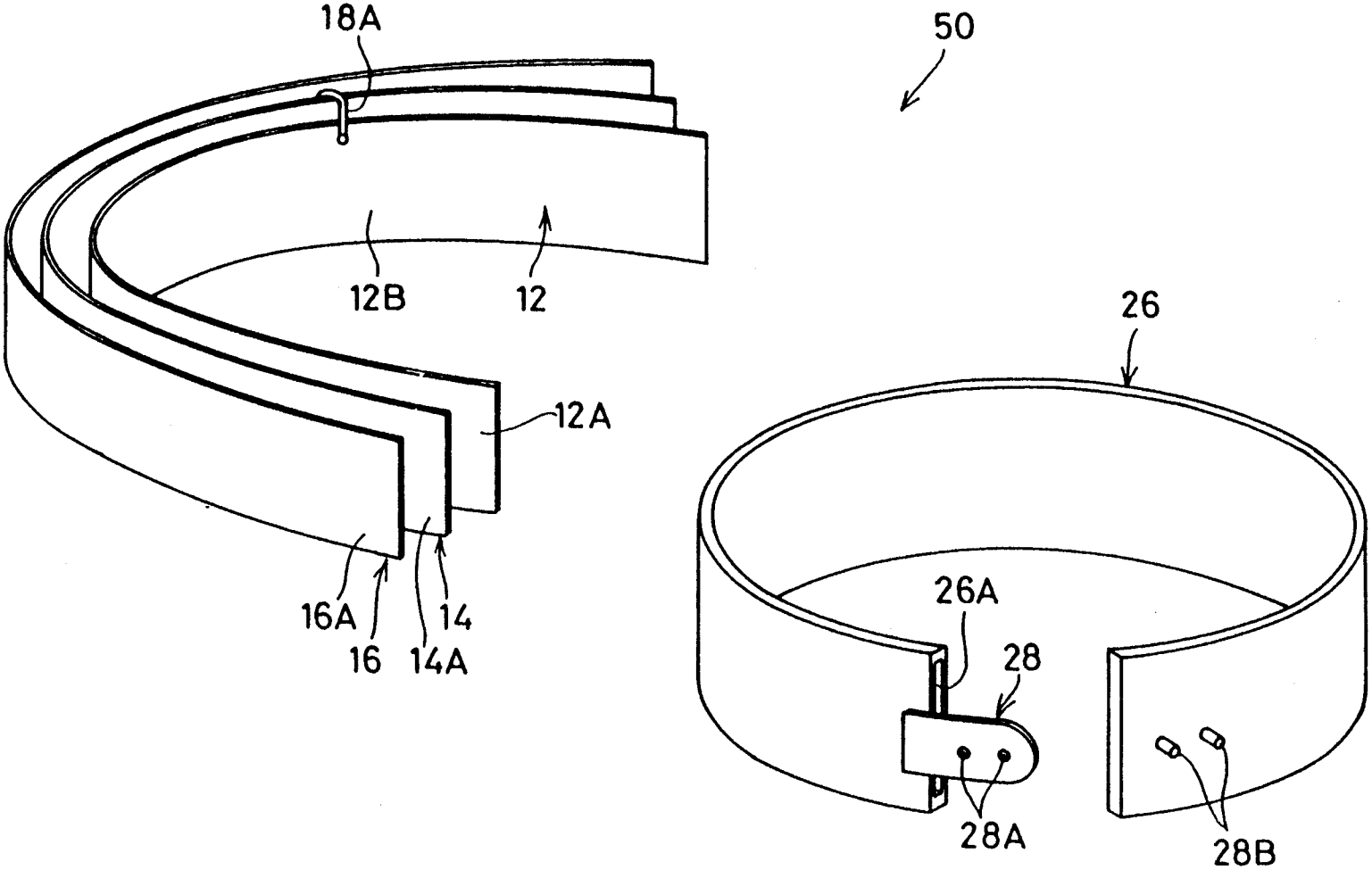
FIG. 5 is an exploded perspective view of the efficient auxiliary engine combustion system of the second preferred embodiment.

FIG. 5 shows a second preferred embodiment of the efficient auxiliary engine combustion system 50 of the present invention. Those structures which are identical to the structures in the first preferred embodiment are numbered with the same reference numbers as used for the first embodiment, and an explanation thereof will be omitted.

As shown in FIG. 5, the rubber plate 14 is located on the outer surface 12*a* of the first copper plate 12 of the above mentioned efficient auxiliary engine combustion system 50. The second copper plate 16 is located on the outer surface 14*a* of this rubber plate 14. The capacitor 18 is installed on the inner surface 16*b* of this second copper plate 16. The first terminal 18*a*, which protrudes from one end of the capacitor 18, is fastened to the outer surface 16*a* of the second copper plate 16 with solder. Also, the second terminal 18*a*, which protrudes from the other end of the above mentioned capacitor 18, is fastened to the inner surface 12*b* of the first copper plate 12 with solder. Thus the above mentioned rubber plate 14 and capacitor 18 are located between the above mentioned first copper plate 12 and the second copper plate 16.

Since the other structures are identical to the first preferred embodiment, explanation thereof is omitted. The efficient auxiliary engine combustion system 50 of the present utility model is installed at the air intake line 32 of the engine 30 by the same method as in the first preferred embodiment.

When the engine 30 starts running, air flows into the air intake line 32 and thereby static electricity is charged on the air intake line 32 and the electricity charges the capacitor 18. Capacitance is thereby produced between the first copper plate 12 and second copper plate 16, and positive ions are generated on the surfaces of the first copper plate 12 and second copper plate 16 by electrostatic induction action.

As in the first embodiment, negative ions in electrically cohesive condition in the air or fuel in the combustion chamber 36 of the engine 30 are neutralized and decomposed by the positive ions generated on the surfaces of the first copper plate 12 and second copper plate 16, and the air in this condition is fed into the combustion chamber 36.

Since the efficient auxiliary engine combustion system 50 of the second preferred embodiment does not require the third copper plate and ground wire as compared to the efficient auxiliary engine combustion system 10 of the first preferred embodiment, a small size, low priced efficient auxiliary engine combustion system 50 can be made feasible.

Figure 6:
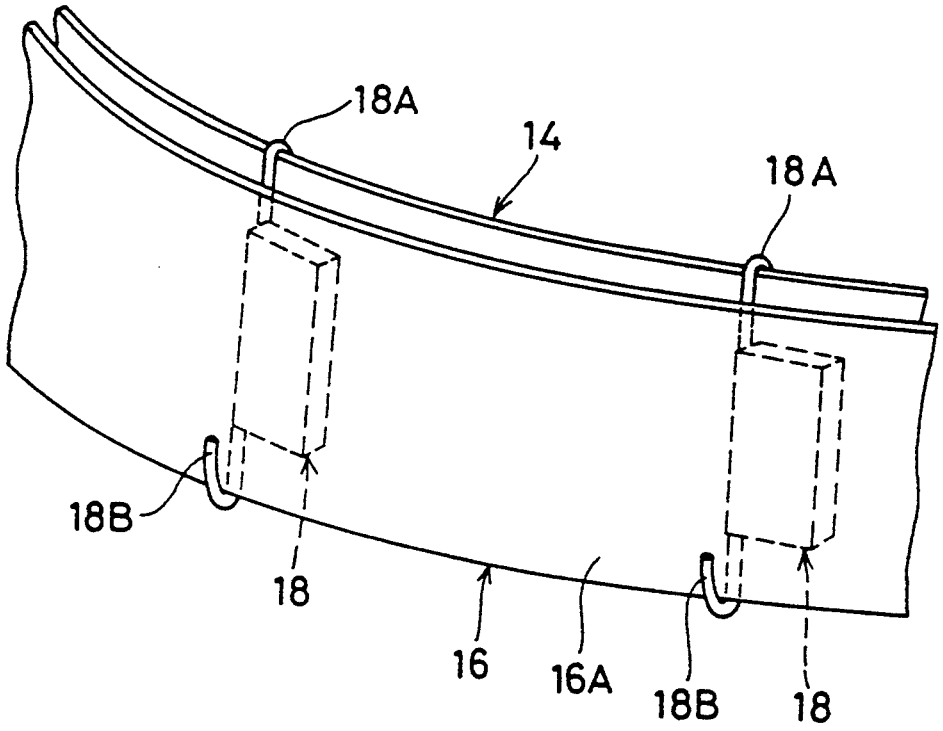
FIG. 6 is a partially enlarged perspective view of the rubber plate and second copper plate of the efficient auxiliary engine combustion system of the second preferred embodiment.

Although the first preferred embodiment, as well as the second preferred embodiment, show the efficient auxiliary engine combustion systems 10 and 50 equipped with a single capacitor 18 respectively, two or more capacitors 18 can be installed as shown in FIG. 6. The installation of plural capacitors 18 has the advantage in that the system is more suitable to large-capacity engines due to larger capacitance, and the appearance can be improved by having a thicker dimension as a whole by the installation of plural capacitors 18.

While the preferred embodiment shows the installation of the efficient auxiliary engine combustion systems 10 and 50 on a diesel engine 30, the systems can also be installed on gasoline and other types of engines. Moreover, the combustion systems 10 and 50 can also be installed at the fuel feeding pipe of the diesel engine 30. Further, while the first copper plate 12, rubber plate 14, second copper plate 16, capacitor 18, and third copper plate 20, are shown encased in the cover 26 of the efficient auxiliary engine combustion systems 10 and 50 of the preferred embodiment, this is not necessarily a requirement.

Also, while in the preferred embodiment the first metal plate 12, second metal plate 16, and third metal plate 20 of the efficient auxiliary engine combustion systems 10 and 50 are formed from copper plates, they can also be formed from other metal plates such as aluminum plates, tin plates, brass plates or the like. Likewise, the rubber plate 14 can be formed from other types of dielectric insulators such as plastic, paper or the like. While the efficient auxiliary engine combustion systems 10 and 50 are installed by inserting the protrusions 28*b* into the holes 28*a* of the tongue 28 of the cover 26 in the preferred embodiment, the systems can also be installed by other methods.

Finally, while the capacitor 18 is disclosed as installed between the first copper plate 12 and the second copper plate 16, the capacitor 18 may be installed between the second copper plate 16 and the third copper plate 20.

As explained above, the use of the efficient auxiliary engine combustion system of the present utility model has the excellent effect that the emission of carbon monoxide, black smoke and other undesirable exhaust emissions can be controlled, and fuel efficiency can be improved through the improvement in combustion efficiency.

The objects and advantages of the invention have thus been shown to be attained in an economical, practical and facile manner.

While a preferred embodiment of the invention has been herein illustrated and described, it is to be appreciated that various chambers, rearrangements and modifications may be made therein, without departing from the scope of the invention as defined by the appended claims.

What is claimed is:

1. An efficient auxiliary engine combustion system for installation on an engine air intake or fuel delivery line comprising:

a first metal plate proximate the engine air intake or fuel delivery line having an outer surface;

an inner surface of a dielectric insulator located on the outer surface of the first metal plate;

an inner surface of a second metal plate located on an outer surface of the dielectric insulator;

a capacitor located on a surface of the dielectric insulator; and a third metal plate located about the outer surface of the second metal plate.

2. the invention set forth in claim 1, wherein a plurality of capacitors are located on a surface of the dielectric insulator.

3. The invention set forth in claim 1, wherein the first plate dielectric insulator, second plate, capacitor, and third plate are encased in a cover.

4. The invention set forth in claim 3, wherein the cover further comprises protrusions on a tongue thereof and corresponding holes, wherein the system is installed by inserting the protrusions into the holes of the tongue of the cover.

5. The invention set forth in claim 1, wherein the material of the dielectric insulator consists of the group including plastic, paper and rubber.

6. The invention set forth in claim 1, wherein the material of the metal plates is copper.

7. The invention set forth in claim 1, wherein the capacitor is installed between the first plate and the second plate.

8. The invention set forth in claim 1, wherein the capacitor is installed between the second plate and the third plate.

9. The invention set forth in claim 1, wherein the system is disposed about an outer periphery of the engine air intake or fuel delivery line.

10. An efficient auxiliary engine combustion system for installation on an engine air intake or fuel delivery line comprising:

a first metal plate proximate the engine air intake or fuel delivery line, having an outer surface;

an inner surface of a dielectric insulator located on the outer surface of the first metal plate;

an inner surface of a second metal plate located on an outer surface of the dielectric insulator; and a capacitor located on a surface of the dielectric insulator.

11. The invention set forth in claim 10, wherein a plurality of capacitors are located between the outer surface of the first metal plate and the inner surface of the second metal plate.

12. The invention set forth in claim 10, wherein the first plate, dielectric insulator, second plate, and capacitor are encased in a cover.

13. The invention set forth in claim 12, wherein the cover further comprises protrusions on a tongue thereof and corresponding holes, wherein the system is installed by inserting the protrusions into the holes of the tongue of the cover.

14. The invention set forth in claim 10, wherein the material of the dielectric insulator consists of the group including plastic, paper and rubber.

15. The invention set forth in claim 10, wherein the material of the metal plates is copper.

16. The invention set forth in claim 10, wherein the system is disposed about an outer periphery of the engine air intake or fuel delivery line.

* * * * *